US006644609B1

(12) United States Patent
Scott

(10) Patent No.: US 6,644,609 B1
(45) Date of Patent: Nov. 11, 2003

(54) WALL MOUNTED SHELVING SYSTEM

(76) Inventor: Gene Scott, 3151 Airway Ave., Suite K-105, Costa Mesa, CA (US) 92626

( * ) Notice: Subject to any disclaimer, the term of this patent is extended or adjusted under 35 U.S.C. 154(b) by 0 days.

(21) Appl. No.: 10/242,239

(22) Filed: Sep. 11, 2002

(51) Int. Cl.[7] ..... A47G 29/02
(52) U.S. Cl. ..... 248/243; 248/345.1; 248/909
(58) Field of Search ..... 248/243, 345.1, 248/235, 250, 909, 220.42, 220.22; 108/108

(56) References Cited

U.S. PATENT DOCUMENTS

| | | | | |
|---|---|---|---|---|
| 3,234,897 A | | 2/1966 | Berk | |
| 3,574,980 A | | 4/1971 | Keller | |
| 3,604,669 A | * | 9/1971 | Asher | 248/243 |
| 3,707,273 A | * | 12/1972 | Bortz | 248/235 |
| 4,055,318 A | * | 10/1977 | Duckett | 248/243 |
| 4,966,343 A | | 10/1990 | Bessinger et al. | |
| 5,004,198 A | * | 4/1991 | Jager | 248/224.8 |
| 5,004,201 A | | 4/1991 | Bessinger | |
| 5,069,408 A | | 12/1991 | Bessinger | |
| D323,452 S | | 1/1992 | Stumpf et al. | |
| 5,253,835 A | | 10/1993 | Herron, III | |
| 5,277,393 A | | 1/1994 | Nicholson et al. | |
| D345,499 S | | 3/1994 | Padilla | |
| 5,423,510 A | | 6/1995 | Almoslino | |
| 5,560,580 A | | 10/1996 | Almoslino | |
| 6,484,979 B1 | * | 11/2002 | Medlin, Jr. | 248/205.1 |

FOREIGN PATENT DOCUMENTS

EP 0020842 A2 12/1979

* cited by examiner

*Primary Examiner*—Ramon O. Ramirez
(74) *Attorney, Agent, or Firm*—Gene Scott-Patent Law & Venture Group

(57) ABSTRACT

A wall mounted shelf system comprises plural elongate bracket standards adapted for securement on a wall surface, and engaged in slots on faces of the bracket standards, plural shelf brackets support at least one shelf. Standard covers are positioned as an outer skin, in contact with opposing surfaces of the bracket standards. Apertures in the standard covers each are sized and positioned for tight-fitting around one of the shelf brackets and are open to an end edge so that the standard covers can be installed onto the bracket standards, without disassembling the brackets from the standards. In this manner, an inexpensive cover can be installed on existing shelf systems without disassembly. The butting edges of each of the covers are hidden behind the shelves so that the final appearance of the wall mounted standards may be changed in color, texture and other designer effects.

12 Claims, 4 Drawing Sheets

WALL MOUNTED SHELVING SYSTEM

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to wall mounted book shelves and such, and more particularly to a wall mounted shelving system wherein a standard cover is used to improve the appearance of standards having bracket slots.

2. Description of Related Art

The following art defines the present state of this field:

Stumpf et al., U.S. Des. Pat. No. 323,452 describes a dress cover for shelving standard design.

Padilla, U.S. Des. Pat. No. 345,499 describes a cover for a shelving union design.

Berk, U.S. Pat. No. 3,234,897 describes a shelf system, the combination of a compound standard comprised of a vertical rearward element externally secured and having a plurality of forwardly opening vertically-spaced holes and a forward element anterior to and abutting against the face of the rearward element and having an elongate opening for alignment with said holes, a bracket forward of said forward element and having a vertical rear face wider than said elongate opening abutting the face of said forward element, a downwardly facing. hookdevice extending rearwardly from the upper portion of said rear bracket face through said forward element opening and engaging the wall of a selected hole for retaining engagement in said, rearward element, and a shelf supported on said bracket whereby said forward element is frictionally retained in position being pressed between said rearward element and rear face of said bracket, the resistance of the forward element tithe bracket maintaining the attitude of the bracket, and an alignment pin projecting rearward from said. rear bracket face for engagement in said opening to prevent rotation of said bracket.

Keller, U.S. Pat. No. 3,574,980 describes a wooden construction comprising a bracket supported by a single screw in a grooved vertical standard. The groove prevents the bracket from twisting on the screw. Screw holes are provided at intervals in the bottom of the groove so that the bracket may be shifted up or down on the standard. Portions of the groove not occupied by the bracket are filled by a filler strip. The back side of the standard has a central tongue to fit between the edges of two adjacent wall panels whereby the standard also serves as a molding strip to cover the joint between the panels.

Bessinger et al., U.S. Pat. No. 4,966,343 describes a shelving assembly having vertical standards and cantilever brackets, an elongated generally U-shaped cover over each standard, its legs being resiliently biased toward the standard, and there being a space extending in from the apex of the cover and straddled by flanges which integrally join a cross piece forming webs and vertically spaced slots generally coinciding with slots in the standard. The legs hold the cover on the standard. The bracket holds the cover vertically in place. The cover flanges laterally stabilize the bracket. Caps and collars project from the ends of the standards. The brackets have slotted shelving mounts fitted in upper edge recesses of the brackets, each mount having an upper adhesive pad and a vertical jack for temporarily holding a shelf up off the adhesive. The jacks are shiftable down under limited predetermined force to lower the shelf onto the adhesive for anchoring. A wire clip for guiding an electric wire is attachable to the standard by lug engagement.

Bessinger, U.S. Pat. No. 5,004,201 describes a shelving assembly having vertical standards and cantilever brackets, and an elongated cover over each standard. The cover has slots coinciding with the standard slots but of greater length. The cover webs between the slots are shorter than the standard webs. The bracket holds the cover vertically in place. The cover flanges laterally stabilize the bracket. The brackets have lugs that extend through slots on the cover and slots on the standard, and engage behind webs on the standard between the slots. The spaces between the lug front faces and the rear edge of the bracket have receiving portions of a width to receive both standard webs and cover webs. The bracket rear edge also has abutment portions adjacent the bottom of the bracket engaging exposed standard web surface not covered by cover web.

Bessinger, U.S. Pat. No. 5,069,408 describes a shelving assembly having vertical standards and cantilever brackets, and an elongated generally U-shaped cover over each standard. The cover flanges laterally stabilize the bracket. The brackets have V-shaped upper recesses interfitting with slotted hemispherical shelving mounts fitted in the upper edge recesses of the brackets, each mount having a tapered slot configuration complementary to the recess configuration, and having an upper adhesive pad and a vertical jack for temporarily holding a shelf up off the adhesive. The jacks are shiftable down under limited predetermined force to lower the shelf onto the adhesive for anchoring.

Herron, III, U.S. Pat. No. 5,253,835 describes a shelf bracket assembly comprising a plurality of vertical shelf bracket support strips attached to a wall, each said strip having a plurality of slots aligned vertically along the length of said support strips; a plurality of shelf brackets operatively attached to said support strips, each said bracket comprising a base comprising an upper end, a lower end, and vertically aligned hooked portions between said upper and lower ends of a size and shape to lockingly fit within said vertical slots of said support strip, and a horizontal support member fixedly connected to said base and of a size and strength capable of supporting at least half the weight of a shelf; a plurality of covers attached to said support strips for covering said support strips in the space between said shelf brackets, in the space above a top said shelf bracket and in the space below a bottom said shelf bracket.

Nicholson et al., U.S. Pat. No. 5,277,393 describes a shelf-supporting assembly with a vertical standard having a front and back portion, a shelf bracket extending outwardly from the vertical standard, a flange at a base portion of the shelf bracket extending inwardly in parallel with the front portion of the vertical standard, hook-shaped projection extending from the flange, spaced members defining gaps therebetween connecting the front portion of the vertical standard to the back portion, with the hook-shaped projections projecting through the gap defined between the spaced members, removably and supportably attaching the shelf bracket to the vertical standard.

Almoslino, U.S. Pat. No. 5,423,510 describes a decorative covering for a shelving bracket in particular a bracket that is usually formed from sheet metal as an elongated, blade-like arm having mounting hooks engageable in selected slots of a vertical standard. The decorative covering is formed with a first groove for receiving conventional shelf bracket and a second groove for receiving a standard. When applied, the covering completely conceals both the horizontal blade and the vertical standard so as to enhance the appearance of a shelving system and provide the look of finished furniture.

Almoslino, U.S. Pat. No. 5,560,580 describes a decorative covering for a shelving bracket in particular a bracket that is usually formed from sheet metal as an elongated, blade-like arm having mounting hooks engageable in selected slots of a vertical standard. The decorative covering is formed with a first groove for receiving conventional shelf bracket and a second groove for receiving a standard. When applied, the covering completely conceals both the horizontal blade and the vertical standard so as to enhance the appearance of a shelving system and provide the look of finished furniture.

Reith, EP0020842 describes a racked section of metal twin-U type whose middle legs are joined together by the rack properly speaking and whose lateral legs are smaller in height than the preceding ones. It is fitted with ribbons of a flexible material which hide the means for fixing to their support the bottoms of the U of the section. This fixing is obtained by providing along one of the edges of these ribbons means for clipping to the lateral legs of each U. The opposite edge of each ribbon is in the form of a thin lip overhanging the rack so as to partially hide it while allowing the introduction therein of brackets, stops, etc.

The prior art teaches the combination of standards for supporting shelf brackets and also decorative covers for the standards as well as the brackets. However, the prior art fails to teach a flexible, adhesive, plastic decorative cover, for slotted standards that is adapted for fitting onto existing installations without disassembly, and which covers both of the sides and the front face of the standards yet enables shelf brackets to be engaged and disengaged with the standards without removing the covers. The present invention fulfills these needs and provides further related advantages as described in the following summary.

SUMMARY OF THE INVENTION

The present invention teaches certain benefits in construction and use which give rise to the objectives described below.

A wall mounted shelf system comprises plural elongate bracket standards adapted for securement on a wall surface, and engaged in slots on faces of the bracket standards, plural shelf brackets support at least one shelf. Standard covers are positioned as an outer skin, in contact with opposing surfaces of the bracket standards. Apertures in the standard covers each are sized and positioned for tight-fitting around one of the shelf brackets and are open to an end edge so that the standard covers can be installed onto the bracket standards, without disassembling the brackets from the standards. In this manner, an inexpensive cover can be installed on existing shelf systems without disassembly. The butting edges of each of the covers are hidden behind the shelves so that the final appearance of the wall mounted standards may be changed in color, texture and other designer effects.

A primary objective of the present invention is to provide an apparatus and method of use of such apparatus that provides advantages not taught by the prior art.

Another objective is to provide such an invention capable of improving the appearance of a utility wall mounted shelf system.

A further objective is to provide such an invention capable of being easily installed without disassembly of an existing shelf installation.

A still further objective is to provide such an invention capable of being easily cut to size for any shelf spacing.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
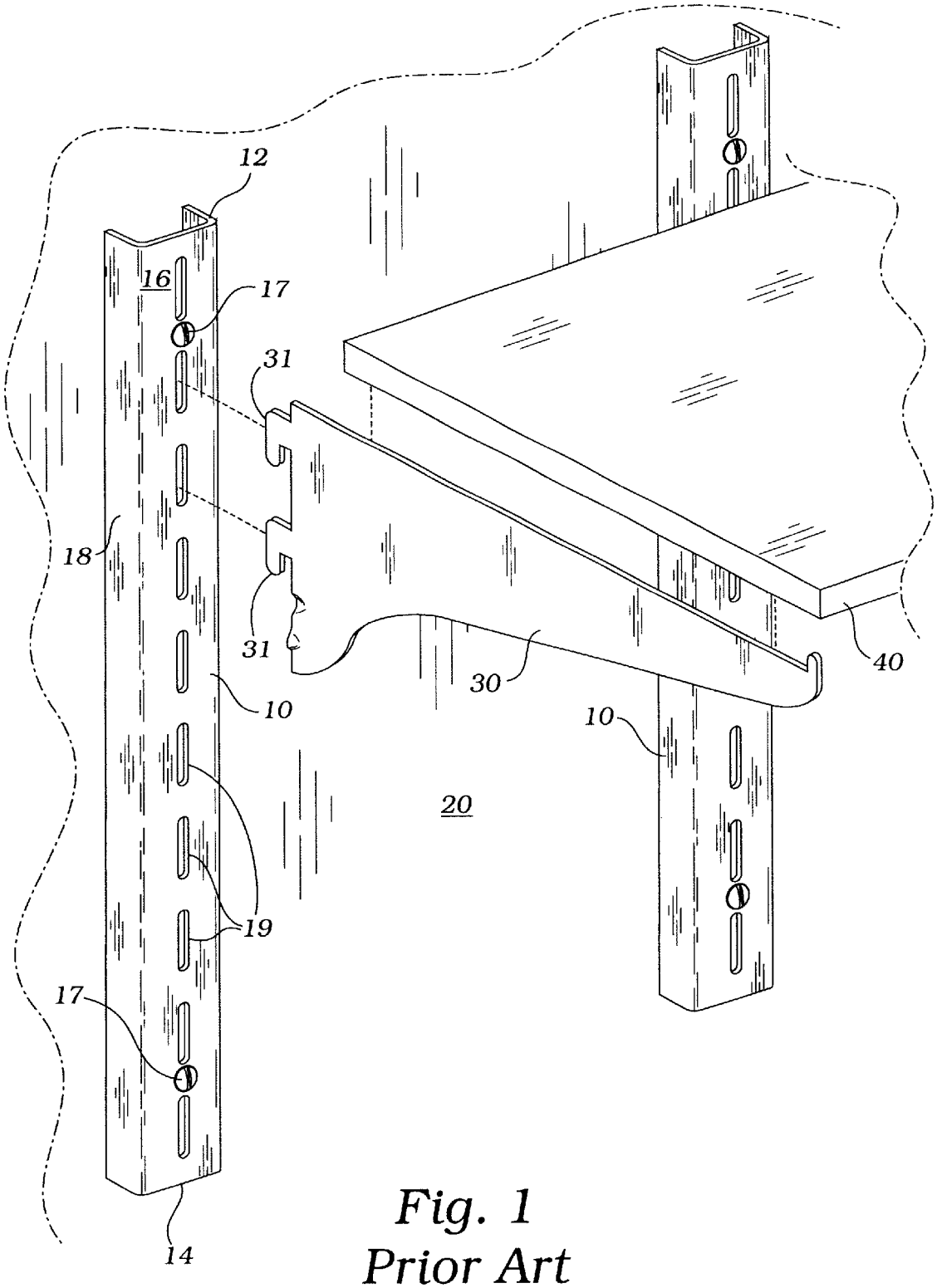
Fig. 1 Prior Art
FIG. 1 is an exploded perspective view of bracket standards, shelf brackets and a shelf of a prior art wall mounted shelving system.
Figure 2:
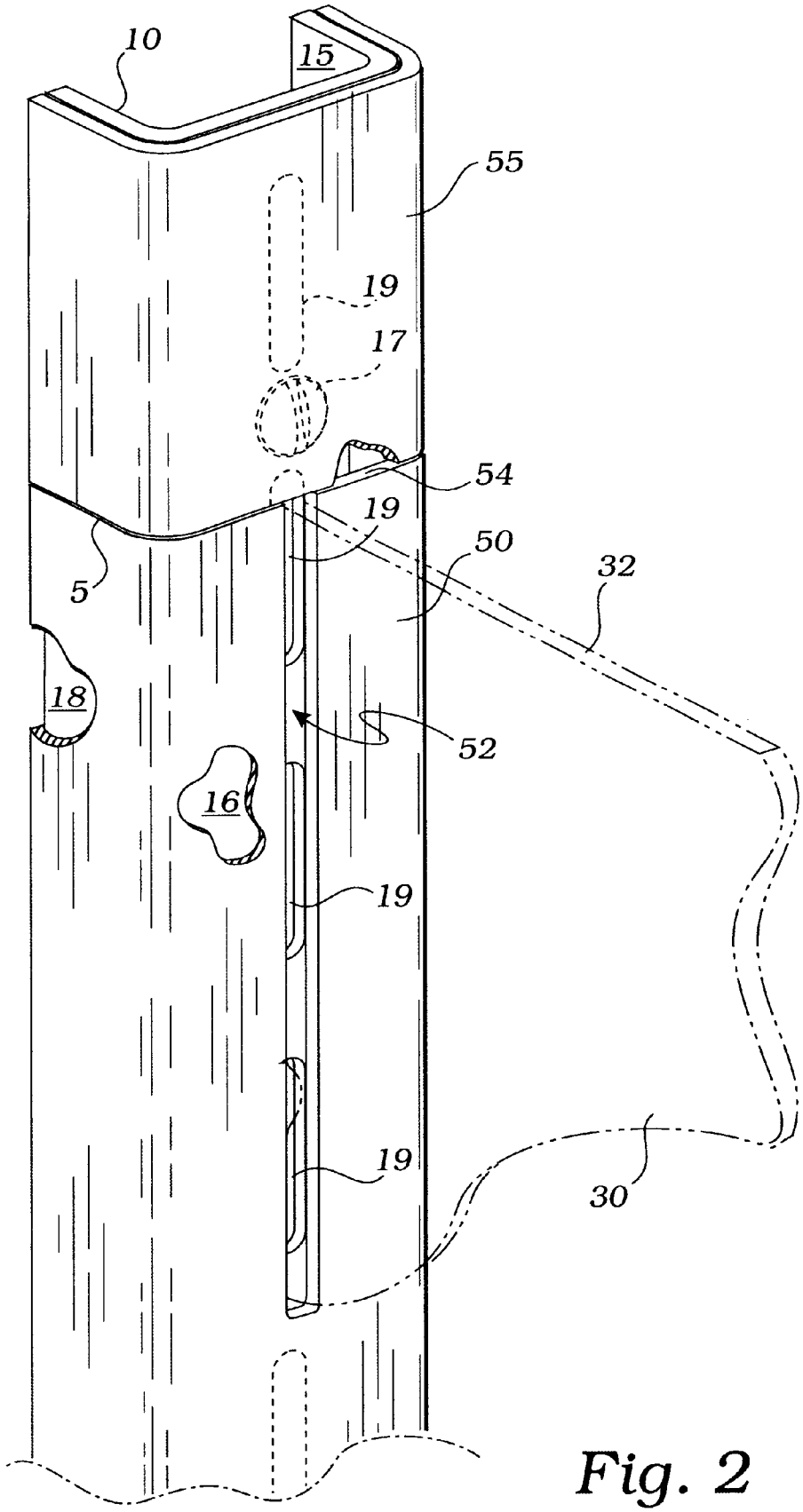
FIG. 2 is a partial perspective view of one of the prior art bracket standards covered by standard covers of a preferred embodiment of the present invention and illustrating how one of the shelf brackets interfaces with the covers and engages the standard.

The present invention is a wall shelving system consisting of plural elongate bracket standards 10, referred to here as "standard(s) 10," two of which are shown in FIG. 1, and this is the least number of such standards 10 that must be used to support a shelf 40. These standards 10 are secured, in vertical attitudes, on a wall 20, usually by common hardware. This type of standard 10 is well known in the prior art, each having a top edge 12, an opposing bottom edge 14 and a series of vertically arranged slots 19 in an outer face surface 16. Two commercial versions are in use; one provides a single column of the slots 19 as shown in FIG. 1, the other provides two columns of side-by-side slots 19. Plural shelf brackets 30, referred to here as "bracket(s) 30," are engaged with the slots 19 using hooks 31, or similar attachment features, integral with the brackets 30, and these brackets 30 extend outward from the standards 10 for supporting shelves 40 which rest on them as is illustrated in FIG. 1. Plural standard covers 50, referred to here as "cover(s) 50," are positioned over the standards 10 as an outer skin, as shown in FIG. 2, and as such, are in contact with the outer face surface 16 as well as opposing outer side surfaces 18, of the standards 10, primarily for covering the slots 19, mounting screws 17 (FIG. 2) and also for providing color, design and other appearance benefits. The standard covers are made of a flexible and easily severed plastic material such as vinyl, preferably by injection molding. In this manner, the bracket standards 10 are able to be transformed from a utilitarian appearance, as is suitable for garage and laundry room installations, to a more formal appearance, as would be acceptable in a bedroom, home office or family room. The covers 50 are advantageously injection molded with, as an example, a wood grain surface texture and then finished to give the standards 10 the appearance of wood to match the wooden shelves 40 and the wood grain painted brackets 30, the latter both being presently commercially available. Generally, more than one of the covers, 50 are used to cover one of the standards. Each of the covers 50 provides an aperture 52, which opens to the top edge 54 of the cover 50 and which is sized and positioned for tight fitting around the brackets 30. Preferably both the standard 10 and the cover 50 are fabricated with a U-shape cross-section, with the standard 10 nestled within the cover 50 as is clear from FIG. 2.

Before further describing the covers 50 of the present invention, the manner of assembly of the wall shelving system should be noted. Typical installations include the steps of first, selecting the surface of a wall 20 suitable for the shelving system. Next, two or more of the standards 10 are mounted in appropriate vertical positions on the wall 20, in a manner that is well known using common hardware 17. This is followed by selecting appropriate vertical positions for the shelves to be supported by the standards 10, and installing the brackets 30 that will hold the shelves 40, in a manner that is also well known and in common use. When all of the brackets 30 have been placed securely into the standards 10, and prior to placing the shelves 40 onto the brackets 30, the covers 50 are now installed on the standards 10. The following describes the manner in which each of the standards 10, in turn, is engaged by the covers 50. A top filler 55 is placed at the top of the standard 10 as is shown in Fig. 2 so that its bottom edge approximately abuts the top surface 32 of the top bracket 30 (uppermost bracket 30 on the standard 10). Next, a cover 50 is placed so that its top edge 54 abuts the bottom edge of the filler 55 and with bracket 30 extending through the aperture 52, as is clearly shown in FIG. 2 where the bracket 30 is shown with phantom lines. The cover 50 has been pre-trimmed to length, as will be described below, so that when it is fully engaged with the standard 10, the bottom edge 56 of the cover 50 abuts the top surface 32 of the next lower bracket 30 on the standard 10. Further covers 50 are placed in the same manner, each abutting the previous cover 50 until the entire standard 10 is fully covered. Preferably, the covers 50 are held in place on the outer surfaces of the standard 10 by an adhesive that permits the cover to be initially positioned, and repositioned, but which thereafter hardens so that the covers 50 do not tend to move out of place over time or under abrasion forces through cleaning, wiping, dusting and the like activities.

Figure 3:
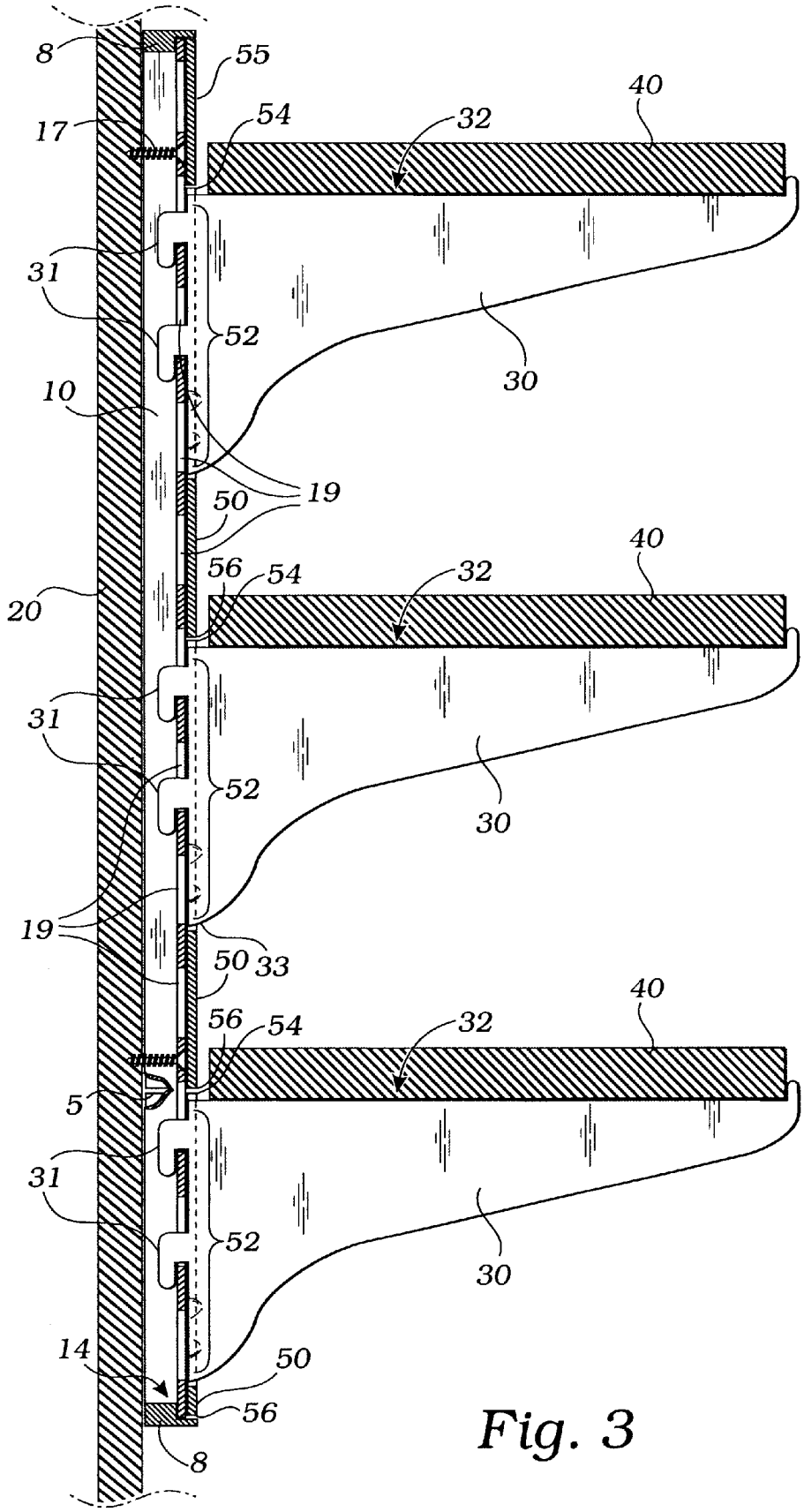
FIG. 3 is a side elevational section view of the invention showing how the standards, brackets, shelves and covers interrelate to each other and to a mounting wall.
Figure 4:
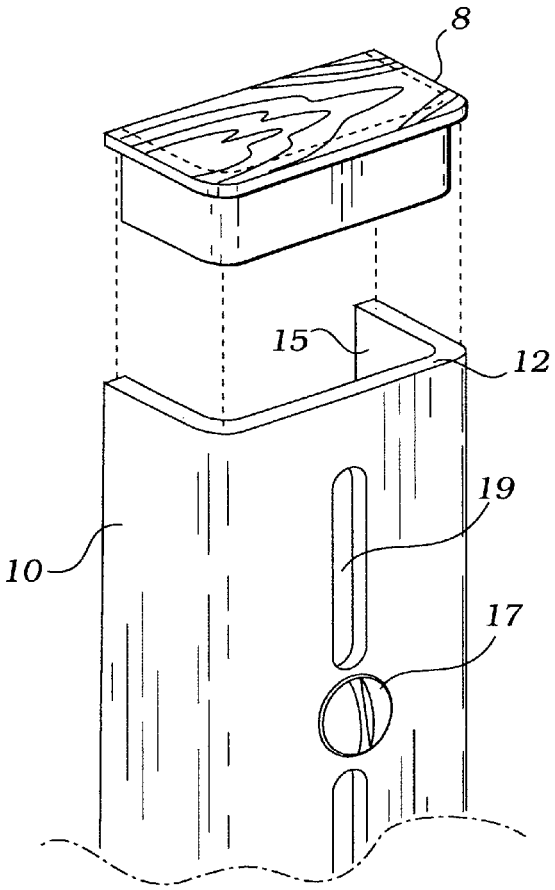
FIG. 4 is a partial perspective view of a standard and an end cap and illustrating how such are engaged.

The installation method described above places cover abutment lines 5 behind the shelves 40 so as to be unnoticed by a casual glance whereby the entire standard takes on a more formal appearance. After all of the standards, in a given installation, are covered, filler caps 8 are inserted into the top and the bottom of each of the standards 50 to complete the installation, except for resting the shelves 40 on the brackets 30. The covers 50 may be installed in the inverse manner, i.e., starting from the bottom of the standard 10 with each cover 50 terminating at the bottom surface 33 (FIG. 3) of each higher bracket 30. However, in this approach, the abutment lines 5 are not hidden behind respective shelves and are therefore more easily noticed.

Figure 5:
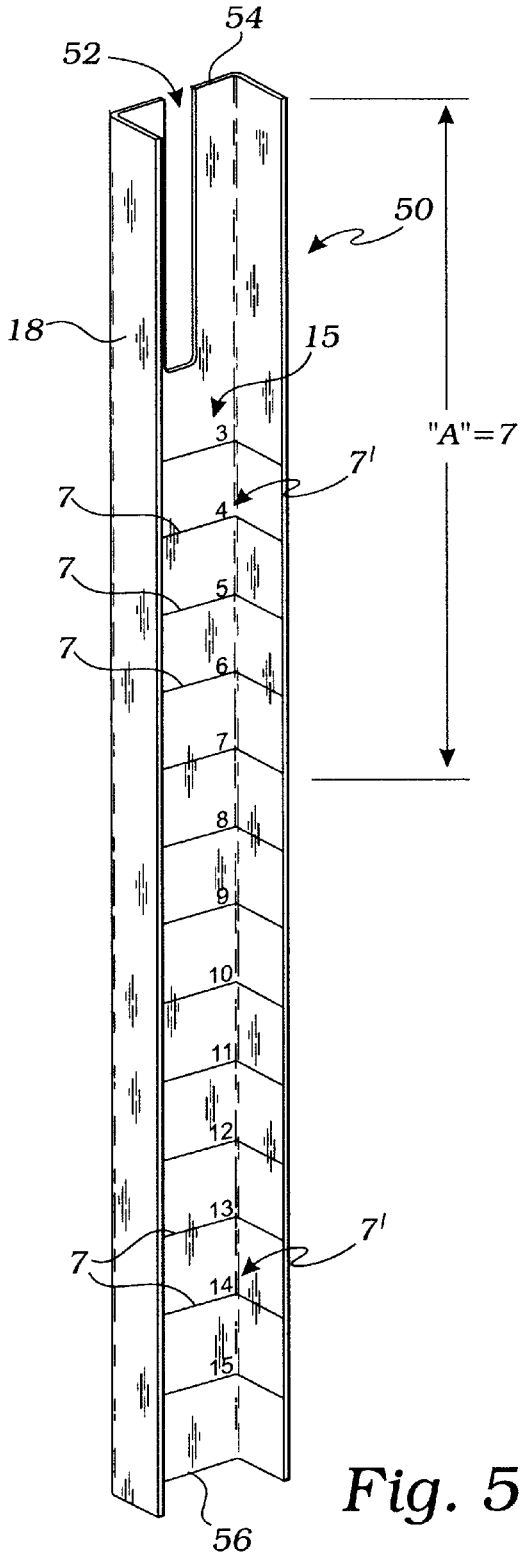
FIG. 5 is a rear perspective view of the cover of the invention showing indicia used as a guide for cutting the cover to length.

The bottom edges 56 of the covers 50 are square-cut and non-apertured. Preferably the bottom edge 56 of each cover 50 lies approximately in-line with the top surface 32 of the next lower bracket on the standard and is therefore in position to abut the top edge 54 of the next lower cover 50. The bottom edge 56 of the lowest cover 50 is trimmed to lay in-line with the bottom edge 14 of the standard 10. The covers 50, as provided, are of a nominal length selected to be greater than the typical distance between the brackets 30, i.e., possibly 12–15 inches. To facilitate accurate trimming to length, so as to exactly fit between adjacent brackets 30, the inside surface 15 of the cover 50 is marked with lateral lines, depressions, or other indicia 7 to be used as a cutting guide to facilitate a straight and square finished lower edge 56. This arrangement is shown in FIG. 5. Depending upon the size and spacing of the slots 19 and the hardware approach for fastening the brackets 30 to the standards 10, which varies from one manufacturer to the next, the locations of the indicia 7 and their spacing will vary. However, the spacing of the indicia 7 is always equal to the spacing between the slots 19, and it is merely a matter of measuring the distance between the top surfaces 32 of adjacent brackets 30 to determine the required length of the corresponding cover 50. By laying off the longitudinal distance "A", as shown in FIG. 5, from the cover's top edge 54, one can easily determine which one of the plural line indicia 7 should be used to trim the cover 50 to appropriate length, i.e., the length between adjacent brackets 30. Preferably, each of the line indicia 7 are marked with a numeral 7' to assure that confusion between the indicia 7 does not occur, which could result in cutting the wrong indicia 7. In one commercially available standard 10, the slots 19 are spaced exactly one inch apart. Therefore, the indicia are marked to indicate how many inches will exist between the top surfaces of the two adjacent shelves 40. FIG. 5 shows indicia 7 and 7' and a distance "A" of 7, which, as mentioned, in one common bracket standard represents that there will be 7 inches between shelves.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A wall mounted shelf system apparatus comprising in combination: plural elongate bracket standards including means for securement of the bracket standards, in vertical attitudes, on a wall surface; engaged in slots on faces of the bracket standards and extending outwardly therefrom, plural shelf brackets supporting at least one shelf resting thereon; and plural standard covers, each one of said standard covers positioned in contact with opposing outer side surfaces, and an outer face surface of one of the bracket standards; each one of said standard covers providing an aperture limited in size for engaging one of the shelf brackets, the aperture open to an upper end edge of the standard cover, enabling installation of the standard covers over the bracket standards and in engagement with the shelf brackets, when the self brackets are already engaged wit the bracket standards.

2. The apparatus of claim 1 wherein the upper end edge of the standard cover is proximate a top surface of the one of the shelf brackets whereby, the upper end edge of the standard cover is masked from view by the at least one shelf.

3. The apparatus of claim 1 wherein the slots on the faces of the bracket standards are arranged in vertical, spaced apart sequence, the standard covers further comprising plural, laterally oriented, linear indicia sequentially arranged in correspondence with the spaced apart sequence of the slots of the bracket standards, the indicia set on a rear inside surface of each of the standard covers such that severing the standard covers along a selected one of the linear indicia enables the standard cover to extend between the top surfaces of two adjacent ones of the self brackets at a desired shelf spacing.

4. The apparatus of claim 3 wherein the linear indicia are depressions.

5. The apparatus of claim 3 wherein the linear indicia further comprise an indicator of shelf spacing.

6. In a wall mounted shelf system providing plural elongate bracket standards having shelf brackets extending outwardly therefrom for supporting shelves, the improvement comprising: plural standard covers, each one of said standard covers positioned in contact with opposing outer side surfaces, and an outer face surface of one of the bracket standards; each one of said standard covers providing an aperture engaging one of the shelf brackets and limited in size thereto, the aperture open to an upper end edge of the standard cover, enabling installation of the standard-covers over the bracket standards and in engagement with the shelf brackets, when the self brackets are already engaged with the bracket standards.

7. The apparatus of claim 6 wherein the upper end edge of each of the standard covers is proximate a top surface of the one of the shelf brackets whereby, the upper end edges of the standard covers are masked from view by the supporting shelves.

8. The apparatus of claim 6 wherein a plurality of slots on the faces of the bracket standards are arranged in vertical, spaced apart sequence, the standard covers further comprising plural, laterally oriented, linear indicia sequentially arranged in correspondence with the spaced apart sequence of the slots of the bracket standards, the indicia set on a rear inside surface of each of the standard covers such that severing the standard covers along a selected one of the linear indicia enables the standard cover to extend between the top surfaces of two adjacent ones of the self brackets at a desired shelf spacing.

9. The apparatus of claim 8 wherein the linear indicia are depressions.

10. The apparatus of claim 8 wherein the linear indicia further comprise an indicator of shelf spacing.

11. A method of improving the appearance of a wall mounted shelf system having plural elongate bracket standards secured in vertical attitudes on a wall surface with plural shelf brackets extending outwardly therefrom for supporting at least one shelf, comprising the steps of; forming an aperture open to an upper end edge of each of a plurality of standard covers; covering the bracket standards with the standard covers, placing the apertures in engagement with the self brackets with the upper end edges of the self brackets proximate top surfaces of the self brackets; and extending each of the standard covers between the top surfaces of two adjacent ones of the self brackets at a desired shelf spacing.

12. The method of claim 11 further comprising the steps of: placing plural, laterally oriented, linear indicia sequentially on a rear inside surface of each of the standard covers, the spacing of linear indicia corresponding to a slot spacing of the bracket standards; and using the indicia as a cutting guide to sever the standard covers to a length equivalent to a selected shelf spacing.

* * * * *